US005961320A

United States Patent [19]

Drago et al.

[11] Patent Number: 5,961,320

[45] **Date of Patent: *Oct. 5, 1999**

[54] BURNER EMISSION DEVICE

[75] Inventors: Thomas E. Drago, Liverpool; Robert H. Swieczkowski, Cazenovia, both of N.Y.

[73] Assignee: Carrier Corporation, Syracuse, N.Y.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/660,719

[22] Filed: Jun. 10, 1996

[51] Int. Cl.[6] ..... F23D 14/12

[52] U.S. Cl. ..... 431/347; 431/350; 431/171; 126/110 R

[58] Field of Search ..... 126/110 R, 116 R, 126/99 R, 91 R; 431/326, 328, 329, 346, 347, 351–354, 350, 170–171

[56] References Cited

U.S. PATENT DOCUMENTS

| | | | |
|---|---|---|---|
| 1,345,342 | 7/1920 | Beall | 99/418 |
| 4,284,402 | 8/1981 | Sheets et al. | 431/171 |
| 4,904,179 | 2/1990 | Drago et al. | 126/110 R |
| 5,174,744 | 12/1992 | Singh | 431/347 |
| 5,244,381 | 9/1993 | Cahlik | 126/116 R |
| 5,333,597 | 8/1994 | Kirkpatrick et al. | 126/110 R |
| 5,370,529 | 12/1994 | Lu et al. | 431/326 |
| 5,580,238 | 12/1996 | Charles, Sr., et al. . | |
| 5,597,301 | 1/1997 | Roy et al. . | |

FOREIGN PATENT DOCUMENTS

| | | |
|---|---|---|
| 97 63 0023 | 9/1998 | European Pat. Off. . |
| 2723175 | 7/1994 | France . |
| 57-019239 | 8/1982 | Japan . |

*Primary Examiner*—James C. Yeung

[57] ABSTRACT

A mixing/quenching device is in the form of a perforate metal sheet or screen secured at the downstream end of a belled orifice with the perforations defining a plurality of flow paths. The dividing and combining of the flow is passing through the flow paths provides turbulence such that thermal $NO_x$ is reduced.

6 Claims, 2 Drawing Sheets

BURNER EMISSION DEVICE

BACKGROUND OF THE INVENTION

In the complete combustion of common gaseous fuels, the fuel combines with oxygen to produce carbon dioxide, water and heat. There can be intermediate reactions producing carbon monoxide and hydrogen. The heat, however, can also cause other chemical reactions such as causing atmospheric oxygen and nitrogen to combine to form oxides of nitrogen or $NO_x$. While $NO_x$ may be produced in several ways, thermal $NO_x$ is associated with high temperatures, i.e. over 2800° F. The flame is zoned so that different parts of the flame are at different temperatures. $NO_x$ production can be reduced with the lowering of the peak flame temperature. The reduction in $NO_x$ can be achieved through turbulence of the gases being combusted which introduces low temperature excess air and/or flue gases into the flame thus reducing the flame temperature.

SUMMARY OF THE INVENTION

The emission device of the present invention is made from either a perforate metal sheet or metal screen with the holes therein defining a plurality flow paths. The flow is divided among these flow paths which increases turbulence due to the recombining of the flows as they exit from the stack. The emission device is located directly in the inshot flame to disrupt the standard flame flow and temperature profiles. These disruptions serve to break up fuel rich zones in the flame, increase surface area of the flame front and provide limited flame quenching.

It is an object of the invention to reduce the production of thermal $NO_x$.

It is another object of this invention to provide increased mixing of an inshot flame.

It is a further object to reduce emission dwell time.

It is another object of this invention to reduce $NO_x$ emissions without increasing CO production at multiple firing rates.

These objects, and others as will become apparent hereinafter, are accomplished by the present invention.

Basically, the flame impinges upon the emission device with the flow dividing and passing through the perforations and recombining. The emission device functions as a turbulator which enhances mixing.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
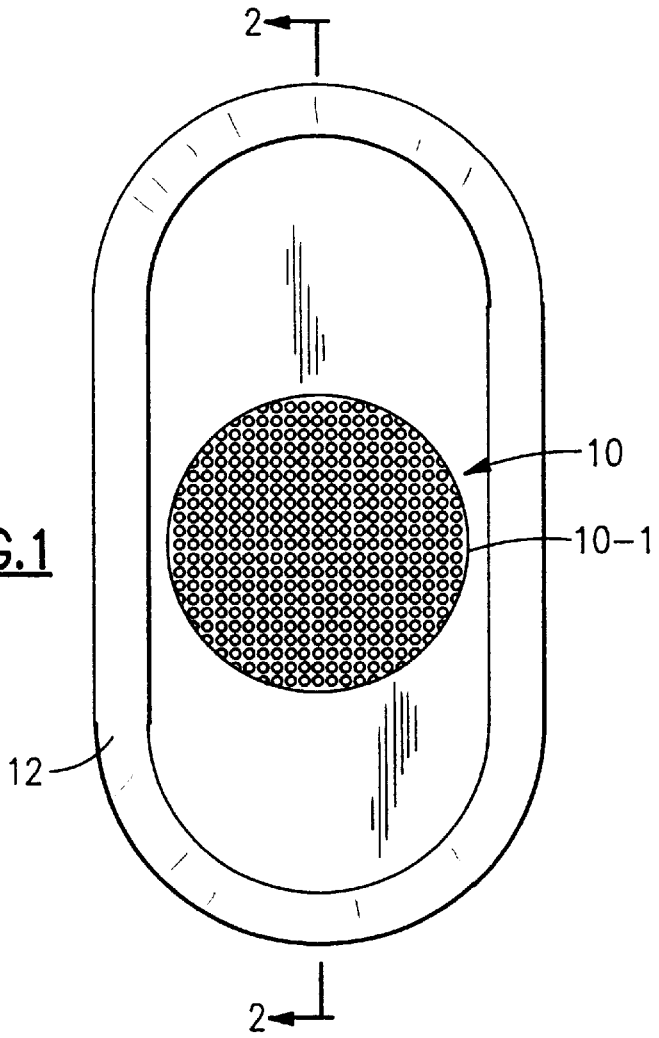
FIG. 1 is an end view of the emission device in place in a belled orifice.
Figure 2:
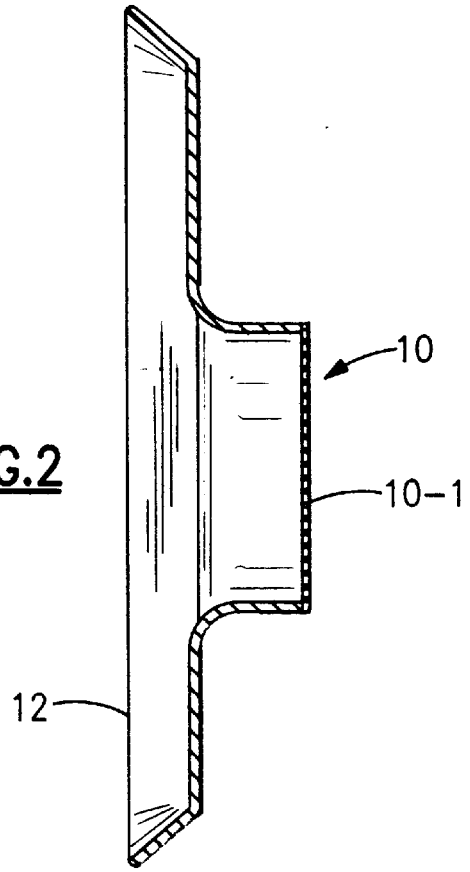
FIG. 2 is a view takes along line 2—2 of FIG. 1.

In the Figures, the numeral 10 generally designates the emission device of the present invention. Emission device 10 is made up of a perforate metal disc or screen welded or otherwise suitably secured at the downstream end of belled orifice 12. The perforations 10-1 form flow paths through emission device 10. In a preferred embodiment, the diameter of flow paths 10-1 will be on the order of 0.038 inches with the centers of adjacent flow paths 10-1 spaced on the order of 0.050 inches apart. The total open area will be on the order of 46%, and the area of each flow path is on the order of 0.00113 square inches. The open area or porosity will generally be between 40 and 55% while the cross sectional area of the flow paths can range between 0.0005 and 0.002 square inches and meet the objects of the present invention. The emission device 10 is made of a suitable, heat resistant material such as 310 stainless steel. The flow paths defined by perforations 10-1 cause the flow to divide into a large number of flow paths with subsequent recombining resulting is a very turbulent flow being induced by passage through emission device 10.

Figure 3:
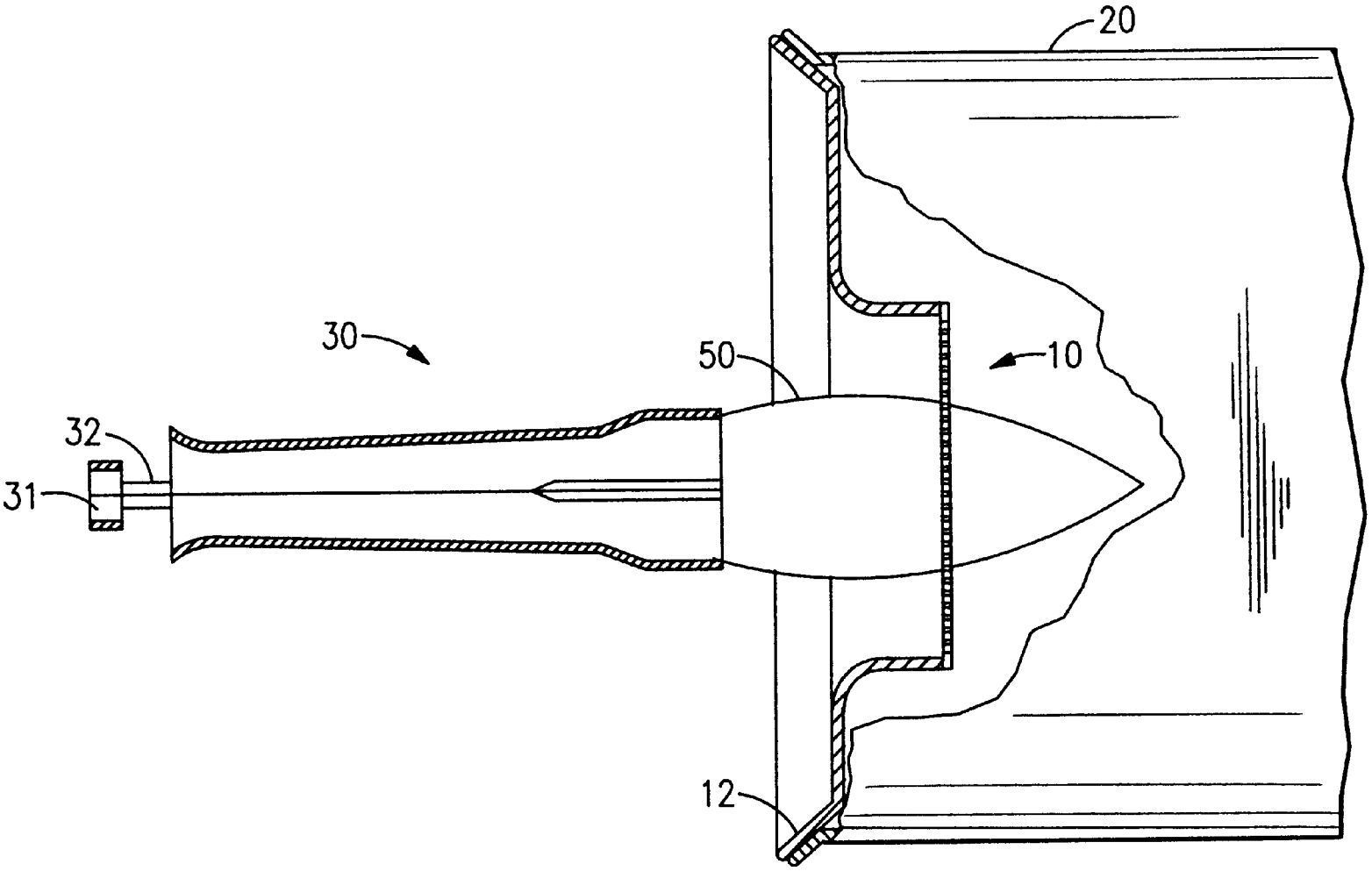
FIG. 3 is a sectional view of the burner, emission device and heat exchanger in place.

Turning now to FIG. 3, the emission device 10 is secured in the belled orifice 12 which is, in turn suitably secured in inlet of heat exchanger 20. Inshot burner 30 is spaced from and faces emission device 10 by a distance such that the emission device 10 is in a position corresponding to the location of the tip of the inner cone of the flame from burner 30 in the absence of emission device 10. Normally, the burner's flame goes into heat exchanger 20 so that emission device 10 is in the normal area of the flame.

In operation, gaseous fuel is supplied under pressure to port 31 of burner 30. The gas supplied to port 31 passes annular opening 32 aspirating atmospheric air which is drawn into burner 30. The fuel air mixture exits burner 30 in flame 50. Flame 50 impinges upon emission device 12 disrupting the standard flow and temperature profiles as the burning fuel-air mixture divides and passes through paths defined by perforations 10-1 and emerges therefrom as a flame. The disruption of the flow due to dividing and recombining for passage through paths 10-1 breaks up fuel rich zones in the flame and causes turbulence which promotes burning by increasing the surface area of the flame heat. The turbulence interferes with the establishment of a stable flame relative to the location of the inner and outer cone which results in the hottest part of the flame defined by the outer cone moving about. The unstable flame tends to lower the peak temperature and thereby reduce the production of thermal $NO_x$.

Although a preferred embodiment of the present invention has been described and illustrated, other changes will occur to those skilled in the art. It is therefore intended that the scope of the present invention is to be limited only by the scope of the appended claims.

What is claimed is:

1. In combination with an inshot gas burner and a heat exchanger, a burner emission device for reducing $NO_x$ comprising:

a single perforate member having a plurality of holes therein;

said holes have an area on the order of 0.0005 to 0.002 square inches;

a support member;

said perforate member supported by said support member with said holes defining a plurality of flow paths through said perforate member;

said support member is secured to said heat exchanger and said perforate member is located opposite said burner directly in a flame from said burner when said burner is in use such that said flame and related temperature profiles are disrupted and flow from said burner impinges upon said perforate member and the resulting burning fuel-air mixture passes through said perforate member only a single time with said flow dividing in passing through said plurality of holes with subsequent recombining with turbulence such that $NO_x$ production is reduced.

2. The combination of claim 1 wherein said perforate member is metal.

3. The combination of claim 2 wherein said metal is stainless steel.

4. The combination of claim 1 wherein said support member is a belled orifice.

5. The combination of claim 1 wherein said holes are round.

6. In combination with an inshot gas burner and a heat exchanger, a burner emission device for reducing $NO_x$ comprising:

a single perforate member having a plurality of holes therein;

said perforate member has a porosity of 40–55%;

a support member;

said perforate member supported by said support member with said holes defining a plurality of flow paths through said perforate member;

said support member is secured to said heat exchanger and said perforate member is located opposite said burner directly in a flame from said burner when said burner is in use such that said flame and related temperature profiles are disrupted and flow from said burner impinges upon said perforate member and the resulting burning fuel-air mixture passes through said perforate member only a single time with said flow dividing in passing through said plurality of holes with subsequent recombining with turbulence such that $NO_x$ production is reduced.

* * * * *